US005305580A

United States Patent [19]

Draghetti

[11] Patent Number: 5,305,580

[45] Date of Patent: Apr. 26, 1994

[54] METHOD OF PRODUCING TUBULAR WRAPPINGS

[75] Inventor: Fiorenzo Draghetti, Medicina, Italy

[73] Assignee: G.D Societa' Per Azioni, Italy

[21] Appl. No.: 947,997

[22] Filed: Sep. 21, 1992

Related U.S. Application Data

[63] Continuation of Ser. No. 712,051, Jun. 7, 1991, abandoned.

[30] Foreign Application Priority Data

Jun. 11, 1990 [IT] Italy ..... 3548 A/90

[51] Int. Cl.[5] ..... B65B 49/00; B65B 49/12

[52] U.S. Cl. ..... 53/465; 53/587; 53/399

[58] Field of Search ..... 53/211, 216, 399, 463, 53/465, 587

[56] References Cited

U.S. PATENT DOCUMENTS

| | | | |
|---|---|---|---|
| 3,035,379 | 5/1962 | Cloots | 53/463 |
| 3,149,446 | 9/1964 | Hood | 53/211 X |
| 3,266,213 | 8/1966 | Harris et al. | 53/211 X |
| 3,290,861 | 12/1966 | Prager | 53/214 |
| 3,659,394 | 5/1972 | Hartleib et al. | 53/465 X |
| 4,245,452 | 1/1981 | Fujio | 53/399 |
| 4,694,633 | 9/1987 | Fujio et al. | 53/587 X |

FOREIGN PATENT DOCUMENTS

| | | | |
|---|---|---|---|
| 719595 | 6/1942 | Fed. Rep. of Germany | 53/216 |

*Primary Examiner*—Horace M. Culver
*Assistant Examiner*—Linda Johnson
*Attorney, Agent, or Firm*—Marshall, O'Toole, Gerstein, Murray & Borun

[57] ABSTRACT

A method of producing tubular wrappings for parallelepiped products or similar, whereby the products and respective portions of wrapping material are fed successively on to a respective first and second conveyor and fed continuously along a common route, along which each portion of wrapping material is transferred on to the first conveyor by a pair of supports supporting a respective product and supported on and moving with the first conveyor, each pair of supports being rotated for wrapping a respective portion of wrapping material about the respective product and so forming a respective tubular wrapping, the opposite portions of which are overlapped and welded together by a welding device assigned to each pair of supports.

4 Claims, 4 Drawing Sheets

METHOD OF PRODUCING TUBULAR WRAPPINGS

This application is a continuation, of application Ser. No. 07/712,051, filed Jun. 7, 1991, and now abandoned.

BACKGROUND OF THE INVENTION

The present invention relates to a method of producing tubular wrappings.

In particular, the present invention relates to a method which may be employed to advantage on cigarette packing machines for producing the tubular outer wrapping, preferably but not necessarily parallelepiped or similar in shape, or the tubular transparent wrapping of so-called "soft" packs.

On known packing machines, the above tubular wrappings are normally produced by successively feeding sheets of wrapping material over respective openings formed on the periphery of a wrapping wheel and each defining the access to a respective radial seat on the wheel. The wrapping wheel is jogged about its axis so as to successively feed said seats to a loading station where each seat is stopped long enough to receive the unwrapped product. Insertion of the product inside the seat usually results in simultaneous insertion of the respective sheet of wrapping material, which gradually folds in a U about the product as this is fed inside the seat. The length of the wrapping material is normally such that, when the product is fully inserted, the opposite end portions of the sheet project outwards of the seat.

The loading station usually presents a first folding device which, after the product is inserted and before starting up the wrapping wheel again, is activated for folding a first of said end portions, usually the one upstream in relation to the traveling direction of the seat, on to the product. The wrapping wheel is then jogged forward one step to feed the next seat into the loading station and the foregoing seat beneath a fixed outer plate, which engages the second of said end portions and folds it backwards on to the product, at least partially overlapping the first end portion. For one or more successive steps of the wrapping wheel, the product, with the end portions of the wrapping material folded as described above, slides underneath the fixed outer plate, which provides for holding the end portions of the wrapping material in the downfolded overlapping position.

This continues until the product is arrested on the wrapping wheel at a joining station where the fixed outer plate ends and the product is arrested in such a position as to partially project beyond the end of the fixed outer plate, but with a sufficiently large portion still engaged by the plate for securing the end portions of the wrapping material in the downfolded overlapping position. At this point, an external joining device, e.g. a gumming or welding device at the joining station, is activated for joining the portion of the two end portions of wrapping material projecting beyond the fixed plate, so as to product said tubular wrapping.

The above method of producing said tubular wrappings therefore requires the use of a jog feed device, in this case the wrapping wheel, for at least enabling the product to be arrested for operating the joining device.

SUMMARY OF THE INVENTION

It is an object of the present invention to provide a method of producing tubular wrappings, which provides for eliminating the use of a jog feed device and, consequently, the speed limitations and relatively high noise levels typically associated with the same.

According to the present invention, there is provided a method of producing tubular wrappings for parallelepiped products or similar, characterised by the fact that it comprises stages consisting in successively feeding said products along a given route together with respective portions of wrapping material, the opposite ends of each said product being engaged by respective supporting means moving along said route, rotating about a transverse axis in relation to said route, and having pickup means for said portions of wrapping material; in successively mating the supporting means of each said product with a respective portion of wrapping material via said respective pickup means, as said portion of wrapping material and said pickup means travel simultaneously through an intermediate pickup point along said route; in rotating the supporting means of each said product about said respective transverse axis, so as to wrap said portion of wrapping material about said product and so form a respective tubular wrapping having overlapping opposite portions; and in welding said opposite portions together via respective welding means traveling with said respective supporting means along said route.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
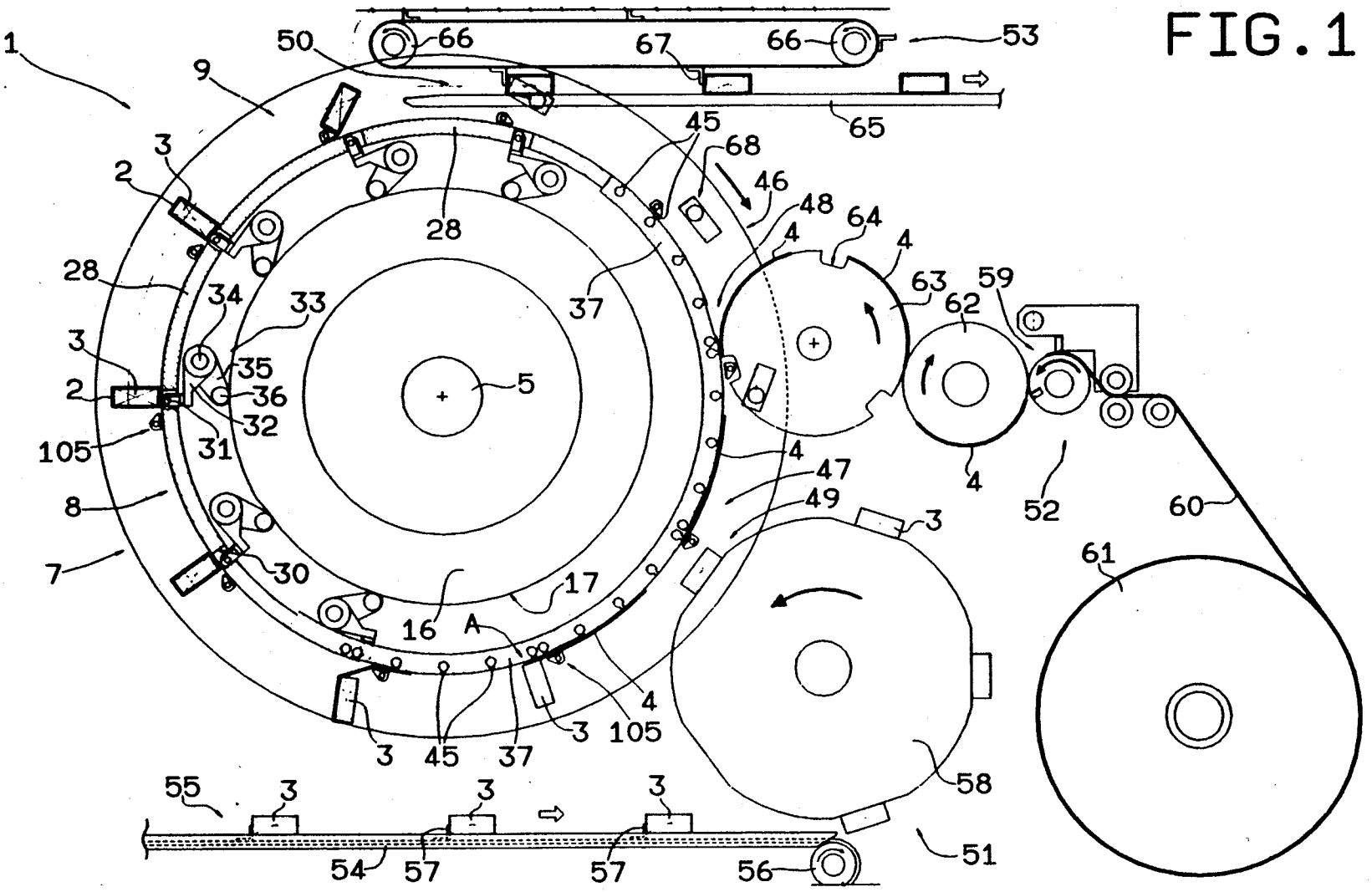
FIG. 1 shows a schematic, partially-sectioned side view, with parts removed for simplicity, of a device implementing the method according to the present invention.

Number 1 in FIG. 1 indicates a device for producing tubular wrappings 2 for products consisting of packets 3.

In the example shown, packets 3 are cigarette packets in the form of a rectangular parallelepipedon, and tubular wrappings 2 are produced from portions 4 of transparent synthetic wrapping material. Device 1 may, however, be adapted, with only minor alterations, for producing tubular wrappings for products differing in shape from packets 3, e.g. cylindrical products.

Figure 3:
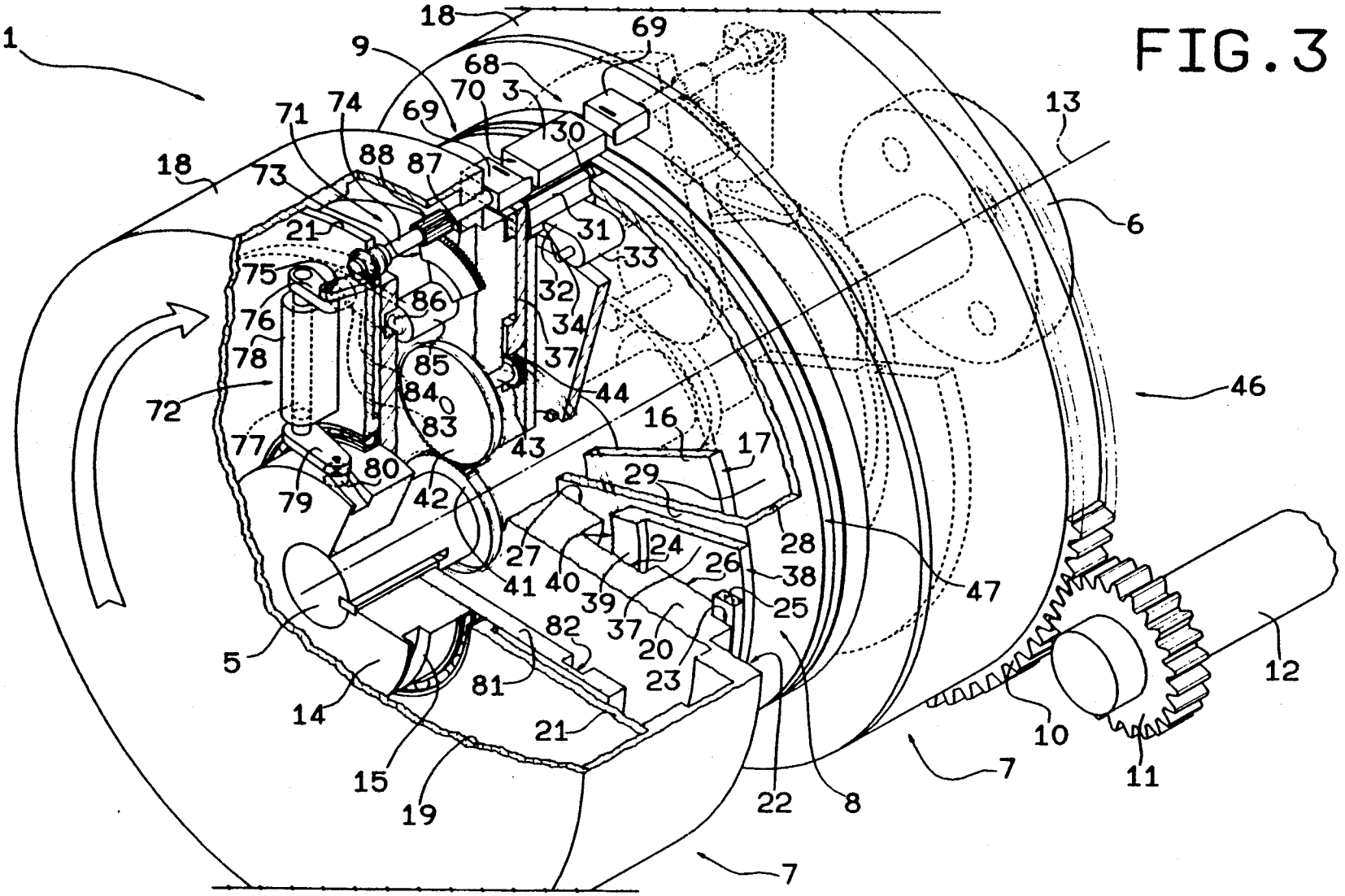
FIG. 3 shows a larger-scale view in perspective of the FIG. 1 device with parts removed for simplicity.

As shown in FIG. 3, device 1 comprises a central shaft 5 projecting from an end flange 6 by which shaft 5 is supported in fixed manner on a wall (not shown). Shaft 5 is fitted with two cylindrical rotary drums 7 substantially identical with each other and located on opposite sides of a central drum 8 smaller in radius and connected integral with drums 7 so as to define, with the same, a recessed annular track 9 in turn defining a common route for packets 3 and respective portions 4. One of drums 7 presents an outer ring gear 10 engaged by a gear 11 fitted on to a powered shaft 12 for rotating drums 7 and 8 clockwise (in FIGS. 1 and 3) about axis 13 of shaft 5.

Inside each drum 7 (only one of which is shown partially sectioned in FIG. 3), shaft 5 is fitted with a cylindrical body 14 having an annular groove shaped to define a lateral cam 15. Similarly, inside central drum 8, shaft 5 is fitted with an annular plate 16, the outer surface of which is shaped to define a cam 17.

Each drum 7 comprises a cylindrical lateral wall 18 coaxial with axis 13 and having, at opposite ends, two transverse walls 19 and 20, at least wall 20 being arranged facing intermediate drum 8 and engaged for rotation by shaft 5. Each drum 7 also presents an annular transverse partition 21 located between walls 19 and 20 and connected in rotary manner to the outer surface of cylindrical body 14 via the interposition of a bearing 155.

As shown in FIG. 3, commencing from the surface of wall 18, the outer surface of each wall 20 presents three annular grooves 22, 23 and 24 coaxial with axis 13. Outer groove 22 terminates in the same plane as the outer surface of central drum 8, so as to widen track 9; groove 23 extends from the inner cylindrical lateral surface of groove 22, and is shallower than groove 22 for housing a ring 25, the surface of which facing central drum 8 presents a duct (not shown) communicating with a suction device (not shown); groove 24 is the same depth as groove 23, and defines, outwards, a sunken flat annular surface 26 defined externally by groove 23 and arranged crosswise in relation to axis 13, and, inwards, a flat annular surface 27 arranged transversely in relation to axis 13, defined internally by shaft 5, and projecting towards central drum 8 in relation to surface 26.

As shown also in FIG. 3, central drum 8 comprises a cylindrical lateral wall 28 defining a central portion of the bottom surface of track 9, and two transverse end walls 29 engaged in rotary manner by shaft 5 and each having an inner portion contacting and connected integral with surface 27 of respective wall 20, for rendering drums 7 integral with each other and with drum 8.

Wall 28 presents a number of equally-spaced axial through openings 30, each fitted through with a respective radially-mobile welding device 31 connected, as shown in FIG. 1, integral with a first arm 32 of a respective rocker arm 33 housed inside central drum 8 and pivoting on a respective pin 34 extending between walls 29, parallel with axis 13, and supported by walls 29 outwards of cam 17. Each rocker arm 33 also comprises a second arm 35 extending towards cam 17 and cooperating with the same via a tappet roller 36.

With facing wall 20, particularly annular surface 26 of wall 20, each transverse wall 29 of central drum 8 defines an annular opening housing a respective annular plate 37, the outer cylindrical surface 38 of which is substantially coplanar with the outer surface of cylindrical wall 28 of drum 8, and a thicker annular peripheral inner portion 39 of which engages groove 24 of respective wall 20. Inside respective groove 24, each peripheral portion 39 is supported for rotation by respective wall 20 via the interposition of a bearing (not shown) located between the outer cylindrical surface of peripheral portion 39 and the outer cylindrical surface of groove 24. Peripheral portion 39 is defined internally by a cylindrical surface coaxial with axis 13 and on which is formed a ring gear 40.

Inside each drum 7, shaft 5 is fitted with a fixed sun gear 41 meshing with a planetary gear 42 fitted on a shaft 43 parallel to axis 13. Shaft 43 extends in rotary manner through respective wall 20, and is fitted with a gear 44 housed inside the inner portion of respective groove 24 not occupied by peripheral portion 39 of respective plate 37, and mating with respective ring gear 40 so as to rotate respective plate 37 in relation to, in the same direction as, and at a slightly higher speed than drums 7 and B.

The outer surface 38 of each plate 37 presents a number of equally-spaced suction holes 45 (FIG. 1) selectively communicating with said suction source (not shown) via ring 25.

Integral drums 7 and 8, on the one hand, and said two annular plates 37, on the other, respectively constitute a first and second conveyor wheel 46 and 47 mounted to rotate continuously about axis 13, wheel 46 at a slightly slower speed than wheel 47, for respectively feeding packets 3 and portions 4 along said common route extending along track 9, and, as shown in FIG. 1, through a first station 48 where portions 4 are loaded on to wheel 47, a second station 49 where packets 3 are loaded on to wheel 46, and an unloading station 50 where packets 3 complete with wrapping 2 are unloaded off wheel 46.

As shown in FIG. 1, in addition to wheels 46 and 47, device 1 also comprises a device 51 for successively feeding packets 3 to loading station 49; a device 52 for successively feeding portions 4 to loading station 48; and a conveyor device 53 for receiving packets 3 complete with wrappings 2 off wheel 46 at unloading station 50.

In the example shown in FIG. 1, device 51 for feeding packets 3 comprises a plate 54 perpendicular to axis 13 and located to the side of wheels 46 and 47; and a conveyor belt 55 looped about pulleys 56 (only one of which is shown in FIG. 1) and having one branch extending along plate 54. Conveyor 55 presents a number of pushers 57 for successively and continuously feeding a number of packets 3 along plate 54, in a direction perpendicular to the longer axis of packets 3, with the larger lateral surface of packets 3 contacting plate 54, to a known transfer wheel 58. Wheel 58 is substantially tangent, on one side, to the bottom of track 9 of wheel 46 at loading station 49 and, on the other, to conveyor 55, and rotates continuously counterclockwise (in FIG. 1) about its axis parallel to axis 13.

Transfer wheel 58 may obviously be eliminated by positioning conveyor 55 tangent to the bottom of track 9 at loading station 49 and as a function of the rotation direction of wheel 46. Alternatively, conveyor 55 may be eliminated or replaced by a further transfer wheel (not shown) similar and tangent to wheel 48.

In the example shown in FIG. 1, device 52 for feeding portions 4 comprises a cutting device 59 for receiving a continuous strip 60 of wrapping material off a reel 61 mounted for rotation about an axis parallel to axis 13, and cutting it into portions 4 having a front or forward portion 106 and a rear or back portion 107, which are fed successively to wheel 47 by two tangent counter-rotating wheels 62 and 63. Wheel 63 is tangent to the bottom of track 9 at loading station 48, and presents a number of axial grooves 64 dividing the outer surface of wheel 63 into sectors longer than portions 4 and functioning as described later on.

In the example shown in FIG. 1, device 53 for unloading wrapped packets 3 off wheel 46 comprises a plate 65 perpendicular to axis 13 and having its input end located between drums 7 and inside but a given distance short of the bottom of track 9. Device 53 consists of a conveyor belt looped about pulleys 66 and having a branch extending along plate 65, and presents a number of pushers 67 for successively and continuously feeding wrapped packets 3 along plate 65, in a direction perpendicular to the longer axis of packets 3, with the larger lateral surface of packets 3 contacting plate 65, to an output channel (not shown).

Figure 4:
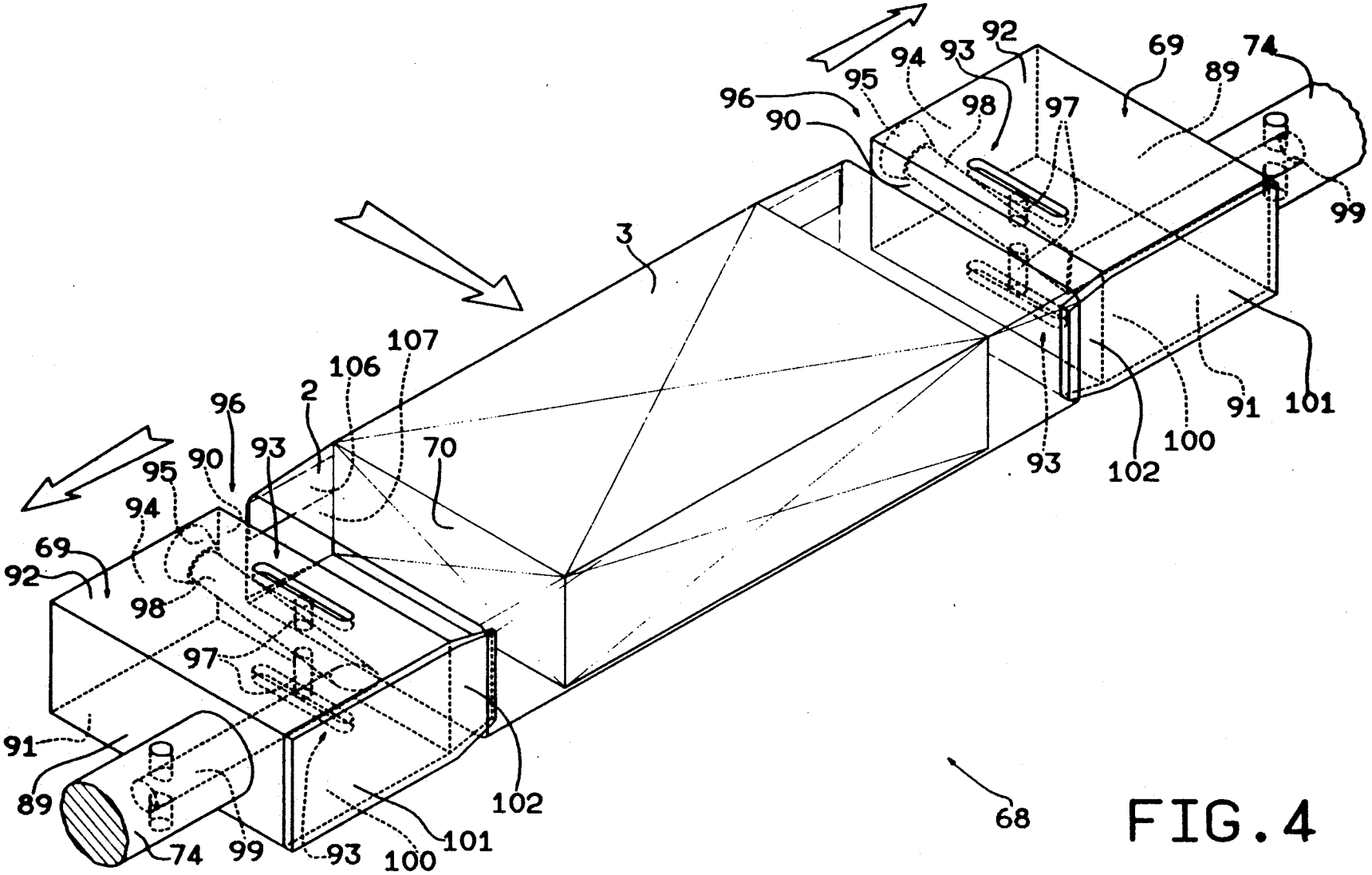
FIG. 4 shows a larger-scale view in perspective of a detail in FIG. 3.

As shown particularly in FIGS. 3 and 4, wheel 46 is fitted, inside track 9, with a number of devices 68 for supporting packets 3. Devices 68 are equally spaced along track 9, are each arranged facing a respective opening 30, and each comprise two pickup blocks 69 cooperating respectively with the smaller axial surfaces 70 of a respective packet 3.

For each pickup block 69, each supporting device 68 comprises an actuating device 71 (FIG. 3) housed inside a respective drum 7 and comprising a device 72 for axially moving respective pickup block 69 to and from the other pickup block 69; and a device 73 for rotating respective pickup block 69 about its axis parallel to axis 13.

As shown in FIG. 3, device 72 comprises a shaft 74 parallel to axis 13 and mounted in sliding and rotary manner through holes formed in partition 21 and wall 20, at a greater distance from axis 13 than the input portion of plate 65. One end of each shaft 74 comes out inside track 9 and is fitted integral with respective pickup block 69, while the other end projects from respective partition 21 towards wall 19 of respective drum 7 and is connected, by means of connecting rod 75, to a lever 76 fitted on to a shaft 77 perpendicular to and positioned radially in relation to axis 13. Shaft 77 is mounted for rotation inside a bush 78 connected integral with respective partition 21, and is fitted, on the end facing shaft 5, with a second lever 79 parallel to lever 76 and fitted in rotary manner on its free end with a tappet roller 80 engaged inside cam 15.

As shown in FIG. 3, rotation device 73 comprises a plate 81 fitted on to shaft 5 just inside and integral with cylindrical body 14. The surface of plate 81 facing respective wall 20 presents a front annular groove defining a front cam 82 engaged by a tappet roller 83 mounted for rotation on the free end of a lever 84 extending radially from a bush 85. Bush 85 is mounted for rotation on a pin 86 parallel to axis 13 and projecting from wall 20 towards plate 81, and is fitted, on the opposite side to that fitted with lever 84, with a sector gear 87 meshing with teeth 88 formed on an intermediate portion of shaft 74 and long enough to enable shaft 74 to slide axially in relation to sector gear 87 while still meshing with the same.

As shown in FIG. 4, each pickup block 69 is substantially in the form of a rectangular parallelepipedon having its axis perpendicular to that of respective shaft 74 and a smaller lateral surface 89 integral with shaft 74. Each block 69 presents a smaller lateral surface 90 opposite surface 89 and designed to contact a respective surface 70 of packets 3; and two larger lateral surfaces 91 and 92, each having an axial opening 93. Each block 69 is also defined by a first lateral end surface 94 located at the rear in relation to the traveling direction of blocks 69, and having a hole 95 which, together with openings 93, constitutes a pickup device 96 for portions 4. By means of ducts 97 and 98 inside block 69, openings 93 and hole 95 are connected to a main duct 99 extending along respective shaft 74 and connected to a suction source (not shown).

Each block 69 is also defined by a second lateral end surface 100 opposite surface 94 and fitted with a sheet metal plate 101, a portion of which projects towards the other block 69, beyond surface 90, so as to form a shoulder 102.

Figure 2:
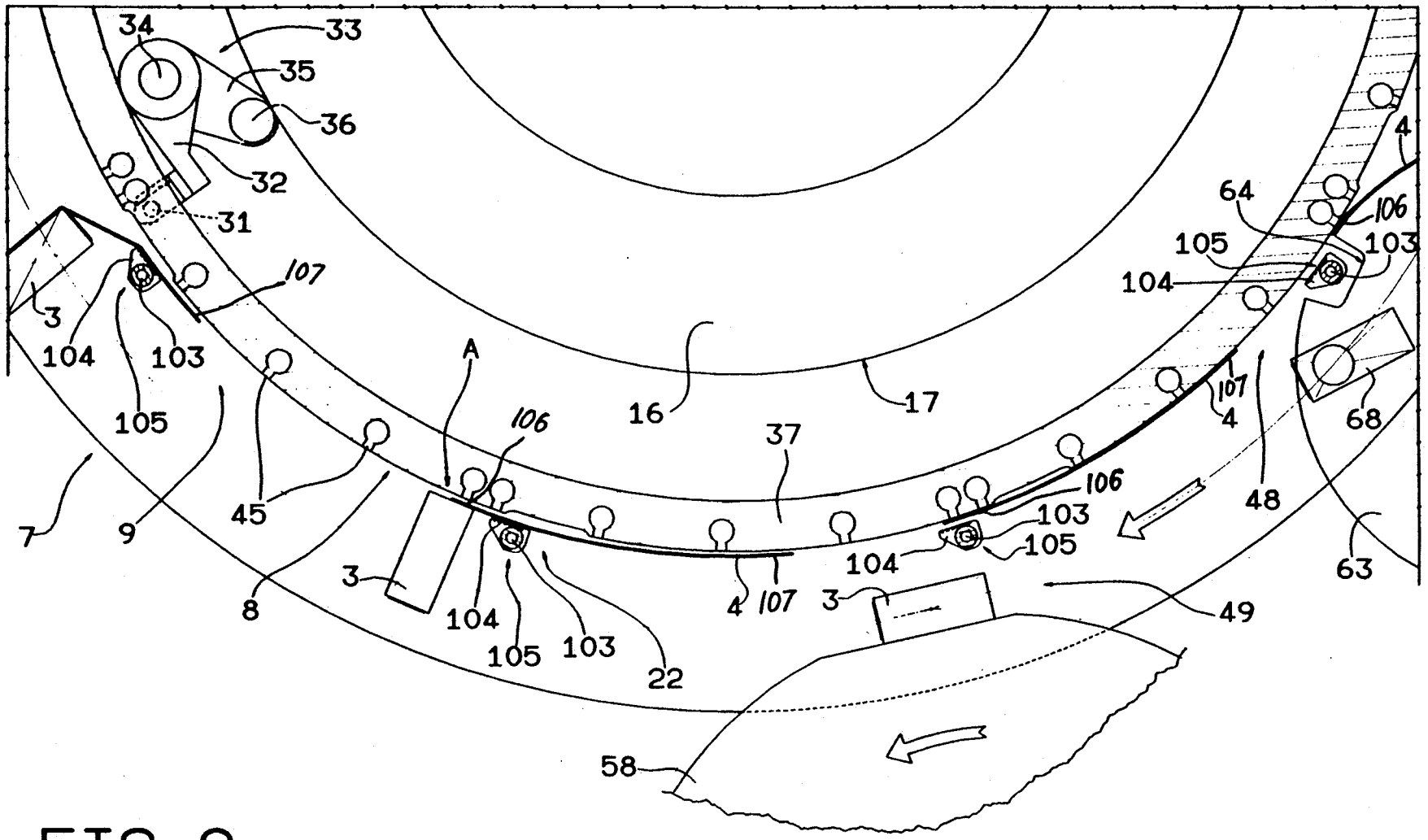
FIG. 2 shows a larger-scale view of a detail on the FIG. 1 device.

As shown in FIG. 1 and particularly in FIG. 2, behind each opening 30, in the rotation direction of wheel 46, there is provided a pin 103 parallel to axis 13 and supported on the ends by walls 20 of drums 7, just outwards of the bottom surface of track 9. Each pin 103 is fitted integral with two pads 104 designed to successively engage the axial grooves on wheel 63, and each arranged facing outer surface 38 of a respective plate 37, at such a relatively short distance from surface 38 as to enable friction feed of portions 4 between pads 104 and respective surfaces 38. Said two pads 104 and respective pin 103 combine to form a brake device 105 functioning as described later on.

As shown in FIG. 1 and particularly in FIG. 2, in actual use, portions 4 are fed successively from wheel 63 to wheel 47 at loading station 48. On wheel 47, portions 4 are held contacting the bottom surface of track 9 by means of suction through holes 45, and are each fed on to wheel 47 immediately upstream from a respective brake device 105.

In the interval between loading stations 48 and 49, blocks 69 of each supporting device 68, originally positioned with surface 100 forward and radial in relation to wheel 46, are turned slightly clockwise so that they are substantially tangent to wheel 58, and then counterclockwise inside station 49 to accompany respective packets 3 as they are inserted between respective blocks 69, which are brought together to grip and successively remove packets 3 off wheel 58.

As already stated, wheel 47 turns in the same direction but slightly faster than wheel 46. In particular, the speed of wheel 47 is so regulated that, for each complete turn of wheel 46, wheel 47 makes one complete turn plus an angle equal to that of the arc between two adjacent supporting devices 68. Consequently, once fed on to wheel 47 immediately upstream from respective brake device 105, each portion 4 starts to inch forward in relation to brake device 105, firstly underneath pads 104 at loading station 49, and eventually past brake device 105 until the front or leading portion 106 of portion 4 encounters a respective packet 3 at pickup point A (FIG. 2) between stations 49 and 50. On leaving loading station 49, packet 3 is turned counterclockwise so that, at point A, surfaces 94 of respective blocks 69 are arranged facing and substantially contacting respective surfaces 38 with said front or leading portion 106 of portion 4 in between.

At this point, the suction through holes 45 is cut off and that through holes 95 and openings 93 on pickup devices 96 activated for mating the front or leading portion 106 of portion 4 with supporting device 68 and enabling supporting device 68, still rotating counterclockwise about the axis of respective shafts 74, to wrap portion 4 about packet 3, despite the drag exerted on portion 4 by brake device 105. At pads 104, brake device 105 may present suction holes (not shown) connected to a suction source (not shown) simultaneously with pickup device 96 of supporting device 68.

Having picked up portion 4 at point A, supporting device 68, as already stated, continues turning counterclockwise, so as to make a complete turn about the axis of respective shafts 74 and so complete wrapping 2 in the space of a roughly 60° turn of wheel 46. At the end of said complete turn, supporting device 68 momentarily stops turning with packet 3 positioned radially in relation to wheel 46, and with a smaller lateral surface substantially contacting wall 28 of drum 8 and covered by two opposite overlapping portions 106 and 107 of portion 4 (FIG. 4). Respective welding device 31 is then activated and comes out through respective opening 30 to weld overlapping portions 106 and 107 as respective supporting device 68 travels over the so-called "welding portion" of its route, and prior to reaching unloading station 50.

Once wrapping 2 has been welded, supporting device 68 starts turning clockwise about the axis of respective shafts 74, and, by the time it reaches unloading station 50, has turned packet 3 roughly 90° in relation to the welding position, so that the larger lateral surface of packet 3 is arranged facing wall 28 of drum 8 and at a distance from the same at least equal to that of plate 65 of conveyor device 53. Thus, by parting respective blocks 69, supporting devices 68 successively and continuously release respective packets 3 on to plate 65 in such a position as to be engaged successively by pushers 67.

In connection with the transfer of packets 3 on to plate 65 of unloading station 50, it should be pointed out that, in the example shown, the rotation axis of shafts 74 of each pair of blocks 69 is offset in relation to packet 3, which position depends on the shape of packet 3 and may even be perfectly centered for given width/thickness ratios of packet 3. Said offset position, if necessary, must be such as to enable packet 3 to be positioned laterally contacting respective welding device 31 in the extracted position, as packet 3 travels over said so-called "welding portion" of its route, and such as to position packet 3 at a given distance other than zero from respective welding device 31 in the extracted position, as packet 3, turned a given angle about the axis of respective shafts 74, reaches unloading station 50.

On wrapping device 1 as described above, wheels 46 and 47 are turned continuously, and loading stations 48 and 49, unloading station 50 and welding devices 31 are designed to function with absolutely no stoppage of wheels 46 and 47.

I claim:

1. A method of producing tubular wrappings (2) about elongated articles (3), comprising the steps of:

a) feeding the articles (3) in succession into end engagement with respective support means (68) and advancing the articles (3) in succession along a path (9) at a first substantially constant speed, with a longitudinal axis (74) of the articles (3) being arranged transversely of a direction of advancement of the support means (68) along the path (9);

b) feeding wrapping portions (4) of wrapping material having a front portion (106) and a back portion (107) in succession along the same path (9) at a second substantially constant speed so that each wrapping portion (4) mates with a corresponding article (3) at a pickup position (A) arranged along the path (9);

c) holding the front portion (106) of each wrapping portion (4) in direct contact with an outer surface of a respective article (3) at the pickup position (A) so that movement of such article (3) results in a corresponding movement of the wrapping portion (4) held thereto;

d) rotating the support means (68) about a longitudinal axis (74) to rotate each article (3) as the article (3) advances along an outlet portion of the path (9) extending downstream from the pickup position (A), and winding the respective wrapping portion (4) about the article (3) in progressive contact with the outer surface thereof and thereby forming a respective tubular wrapping (2) enclosing the article (3) and with the wrapping (2) front and back portions (106; 107) overlapping each other;

e) applying a braking control action to each wrapping portion (4) as it is wound about a respective article (3), said braking control action being applied by frictionally gripping the wrapping portion (4) to exert a drag action thereon; and f) welding together the overlapping front and back portions (106, 107) of each wrapping portion (4) as the wrapping portion (4) advances at said first speed along the outlet portion of the path (9).

2. A method according to claim 1 wherein:

said second speed is higher than said first speed;

said braking control action being applied by feeding each wrapping portion to an inlet portion of the path upstream from respective braking means advancing along the path at said first speed;

advancing the wrapping portion along said inlet portion at said second speed so as to bring the wrapping portion into friction engagement with the respective braking means before reaching the pickup position;

the difference between said first and second speeds being such that a front portion of the wrapping portion overtakes and passes the respective braking means before reaching the pickup position;

holding, at said pickup position, said front portion of the wrapping portion with the respective article advancing at said first speed along said path; and pulling the wrapping portion past and free of the respective braking means as a result of said rotation of the article about the longitudinal axis.

3. A method of producing tubular wrappings (2) about elongated articles (3), comprising the steps of:

(a) feeding the articles (3) in succession into end engagement with respective support means (68) and advancing the articles (3) in succession along a path (9) at a first substantially constant speed, with a longitudinal axis (74) of the articles (3) being arranged transversely of a direction of advancement of the support means (68) along the path (9);

(b) feeding wrapping portions (4) of wrapping material having a front portion (106) and a back portion (107) in succession along the same path (9) at a second substantially constant speed so that each wrapping portion (4) mates with a corresponding article (3) at a pickup position (A) arranged along the path (9);

(c) holding the front portion (106) of each wrapping portion (4) in direct contact with, and across the entire width of, an outer surface of a respective article (3) at the pickup position (A) so that movement of such article (3) results in a corresponding movement of the wrapping portion (4) held thereto;

(d) rotating the support means (68) about a longitudinal axis (74) to rotate each article (3) as the article (3) advances along an outlet portion of the path (9) extending downstream from the pickup position (A), and winding the respective wrapping portion (4) about the article (3) in progressive direct contact with essentially the entire outer surface thereof and thereby forming a respective tubular wrapping (2) enclosing and in direct contact with essentially the entire outer surface of the article (3) and with the wrapping (2) front and back portions (106, 107) overlapping each other;

(e) applying a braking control action to each wrapping portion (4) as it is wound about a respective article (3), said braking control action being applied by frictionally gripping the wrapping portion (4), at a position spaced away from and out of contact with the article and the support means, to exert a pulling action thereon; and (f) welding together the overlapping front and back portions (106, 107) of each wrapping portion (4) as the wrapping portion (4) advances at said first speed along the outlet portion of the path (9).

4. A method according to claim 3 wherein:

said second speed is higher than said first speed;

said braking control action being applied by feeding each wrapping portion to an inlet portion of the path upstream from respective braking means advancing along the path at said first speed;

advancing the wrapping portion along said inlet portion at said second speed so as to bring the wrapping portion into frictional engagement with the respective braking means before reaching the pickup position;

the difference between said first and second speeds being such that a front portion of the wrapping portion overtakes and passes the respective braking means before reaching the pickup position;

holding, at said pickup position, said front portion of the wrapping portion with the respective article advancing at said first speed along said path; and pulling the wrapping portion past and free of the respective braking means as a result of said rotation of the article about the longitudinal axis.

* * * * *